US007451617B2

(12) United States Patent
Renz et al.

(10) Patent No.: US 7,451,617 B2
(45) Date of Patent: Nov. 18, 2008

(54) REFRIGERATION SYSTEM

(75) Inventors: Hermann Renz, Egenhausen (DE); Günter Dittrich, Oschatz (DE)

(73) Assignee: Bitzer Kuhlmaschinenbau GmbH (DE)

( * ) Notice: Subject to any disclaimer, the term of this patent is extended or adjusted under 35 U.S.C. 154(b) by 0 days.

(21) Appl. No.: 11/840,344

(22) Filed: Aug. 17, 2007

(65) Prior Publication Data

US 2008/0011014 A1 Jan. 17, 2008

Related U.S. Application Data

(63) Continuation of application No. PCT/EP2006/000581, filed on Jan. 24, 2006.

(30) Foreign Application Priority Data

Feb. 17, 2005 (DE) ..... 10 2005 009 173

(51) Int. Cl.
*F25B 1/10* (2006.01)

(52) U.S. Cl. ..... 62/510; 62/228.5

(58) Field of Classification Search ..... 62/228.5, 62/509, 510, 511, 513, 515
See application file for complete search history.

(56) References Cited

U.S. PATENT DOCUMENTS 4,197,719 A 4/1980 Shaw
4,254,637 A * 3/1981 Brauch et al. ..... 62/468
5,522,233 A * 6/1996 Nares et al. ..... 62/193
6,105,378 A 8/2000 Shaw
6,145,326 A * 11/2000 O'Brien ..... 62/84

(Continued)

FOREIGN PATENT DOCUMENTS

CH 227856 7/1943

(Continued)

OTHER PUBLICATIONS

Ian Bell, Performance Increase of carbon dioxide Refrigeration Cycle with the Addition of Parallel Compression Economization, paper, 9 pages, XP-000962591, 2/A/4.30.

(Continued)

*Primary Examiner*—Melvin Jones
(74) *Attorney, Agent, or Firm*—Reinhart Boerner Van Deuren P.C.

(57) ABSTRACT

In order to create a refrigeration system comprising a refrigerant circuit (10), in which a main mass flow (56) of a refrigerant is guided, which may be adapted to different operating conditions in an optimum manner it is suggested that at least two refrigerant compressors (12*a*, 12*b*, 12*c*), which can be switched on individually for the purpose of compressing the main mass flow, be arranged in the refrigerant circuit, that at least two of the refrigerant compressors each have at least one additional compressor stage (70), that each of the additional compressor stages be able to be used optionally for the compression of refrigerant from the main mass flow or for the compression of refrigerant from the additional mass flow (86) and that a control (90) be provided, with which such a number of additional compressor stages for the compression of refrigerant from the additional mass flow can be switched on in a first operating mode as a function of the operation conditions that the expansion cooling device (24, 28) liquefies the main mass flow and reduces its enthalpy.

28 Claims, 10 Drawing Sheets

U.S. PATENT DOCUMENTS 6,931,871 B2 * 8/2005 Shaw et al. ..... 62/228.5

FOREIGN PATENT DOCUMENTS

| | | | |
|---|---|---|---|
| DE | 3925090 | A1 | 2/1991 |
| DE | 4309137 | A1 | 8/1994 |
| EP | 0180904 | A2 | 5/1986 |
| EP | 0845642 | A2 | 6/1998 |
| EP | 1357338 | A1 | 10/2003 |
| EP | 1498667 | A2 | 1/2005 |
| GB | 2199931 | A | 7/1988 |
| WO | WO 2006/015741 | A1 | 2/2006 |

OTHER PUBLICATIONS

Sergio Girotto et al., Commercial refrigeration system using CO2 as the refrigerant, journal, 2004, International Journal of Refrigeration 27 (2004), 7 pages, 717-723.

Cosijn E A, Toepassing van tweetraps (compound-) zuigercompressoren in de industriële koeltechniek, Nederlandse Vereniging Voor Koeltechniek, Apeldoorn, NL, vol. 82, No. 5, May 1, 1989, pp. 24-25, XP000022690.

* cited by examiner

REFRIGERATION SYSTEM

CROSS-REFERENCE TO RELATED PATENT APPLICATIONS

This application is a continuation of international application No. PCT/EP2006/000581 filed on Jan. 24, 2006 and claims the priority and benefit of German application No. 10 2005 009 173.3 filed on Feb. 17, 2005, the teachings and disclosure of which are hereby incorporated in their entirety by reference thereto.

BACKGROUND OF THE INVENTION

The invention relates to a refrigeration system comprising a refrigerant circuit, in which a main mass flow of a refrigerant—preferably carbon dioxide—is guided, a heat exchanger arranged in the refrigerant circuit on the high pressure side, an expansion cooling device which is arranged in the refrigerant circuit, cools the main mass flow of the refrigerant in the active state and thereby generates an additional mass flow of gaseous refrigerant, a reservoir for liquefied refrigerant arranged in the refrigerant circuit, at least one expansion unit for liquefied refrigerant of the main mass flow, this expansion unit being arranged in the refrigerant circuit and having an expansion element and a post-connected heat exchanger on the low pressure side which makes refrigerating capacity available, i.e., increases the enthalpy of the refrigerant, and at least one refrigerant compressor which is arranged in the refrigerant circuit and has a main compressor stage and at least one additional compressor stage driven together with the main compressor stage, these two stages compressing refrigerant to high pressure, wherein the main compressor stage and the at least one additional compressor stage can be used such that either the main compressor stage compresses refrigerant from the main mass flow and the additional compressor stage refrigerant from the additional mass flow or the main compressor stage and the additional compressor stage compress refrigerant from the main mass flow.

Refrigeration systems of this type are known from the state of the art, wherein they are designed for customary refrigerants.

Refrigeration systems of this type are described, for example, in EP 0 180 904 A2.

Proceeding from this known state of the art, the object underlying the invention is to create a refrigeration system which may be adapted to different operating conditions in an optimum manner.

SUMMARY OF THE INVENTION

This object is accomplished in accordance with the invention, in a refrigeration system of the type described at the outset, in that at least two refrigerant compressors are arranged in the refrigerant circuit and can be switched on individually for the purpose of compressing the main mass flow, that at least two of the refrigerant compressors each have at least one additional compressor stage, that each of the additional compressor stages can be used optionally for the compression of refrigerant from the main mass flow or for the compression of refrigerant from the additional mass flow and that a control is provided, with which such a number of additional compressor stages for the compression of refrigerant from the additional mass flow can be switched on in a first operating mode as a function of operating conditions that the expansion cooling device liquefies the main mass flow and reduces its enthalpy.

The advantage of the solution according to the invention is to be seen in the fact that this creates the possibility, on account of the variable switchability of the additional compressor stages, of adapting the liquefying of the main mass flow and the reduction in enthalpy to the various operating conditions and, therefore, of always keeping them in an optimum range.

It is particularly favorable when the expansion cooling device reduces the enthalpy of the main mass flow by at least 10%.

It is even more advantageous when the expansion cooling device reduces the enthalpy of the main mass flow by at least 20%. The refrigeration system can be used particularly favorably when the first operating mode corresponds to a supercritical operation, for example, with carbon dioxide as refrigerant.

A supercritical operation is to be understood such that the refrigerant compressed to high pressure cannot be cooled in the heat exchanger on the high pressure side to a temperature which corresponds to an isotherm passing through the boiling point curve and saturation curve of the refrigerant but rather can merely be cooled to a temperature which corresponds to an isotherm extending outside the boiling point curve and saturation curve and so the refrigerant is not liquefied.

Furthermore, a particularly favorable embodiment provides for the expansion cooling device to convert the main mass flow into a thermodynamic state, the pressure and enthalpy of which are lower than pressure and enthalpy of a maximum of the saturation curve or boiling point curve in an enthalpy/pressure diagram.

The thermodynamic state of the main mass flow brought about by the expansion cooling device is preferably close to the boiling point curve of the enthalpy/pressure diagram, in particular, essentially on the boiling point curve or at an enthalpy which is lower than the enthalpy corresponding to the boiling point curve at the respective pressure.

The expansion cooling device may be designed, in principle, in any optional manner.

A particularly favorable solution provides, however, for the expansion cooling device to have an expansion valve for the expansion of refrigerant to an intermediate pressure and for the intermediate pressure of the expansion cooling device to be adjustable by switching on the suitable number of additional compressor stages.

Furthermore, the expansion cooling device could operate, for example, such that only an expansion of the refrigerant forming the additional mass flow takes place.

It is, however, even more advantageous when the expansion valve of the expansion cooling device expands refrigerant of the main mass flow and of the additional mass flow to the intermediate pressure.

With respect to the arrangement of the reservoir for the liquid refrigerant, no further details have so far been given. One particularly favorable solution provides, for example, for the expansion cooling device to also comprise the reservoir for the liquid refrigerant of the main mass flow and, therefore, the construction of the refrigeration system according to the invention is simplified.

A solution which is particularly preferred from a constructional point of view provides for the expansion valve to transfer the expanded refrigerant from the main mass flow and the additional mass flow into a container, in which the reservoir for the liquid refrigerant of the main mass flow is formed, over which a vapor chamber is located, from which the refrigerant forming the additional mass flow is then discharged so that part of the refrigerant vaporizes and, as a result, cools or even supercools the main mass flow.

An additional, advantageous embodiment of the refrigeration system according to the invention provides for the expansion cooling device to be in the inactive state in a second operating mode and to bring about no cooling of the main mass flow.

This means that, in this case, no additional mass flow of refrigerant results and, therefore, the refrigeration system according to the invention can be operated in the conventional, known manner by way of a circuit of the entire refrigerant in the form of the main mass flow.

It is expediently provided in such a second operating mode of the refrigeration system for all the additional compressor stages to compress refrigerant of the main mass flow.

Furthermore, it is provided in a second operating mode of the refrigeration system according to the invention for the reservoir for liquid refrigerant of the main mass flow to be subject to high pressure.

It is provided, in particular, in one embodiment for the second operating mode to correspond to a subcritical operation of the refrigeration system.

A subcritical operation of the refrigeration system within the meaning of the solution according to the invention is to be understood such that such a strong cooling of the refrigerant compressed to high pressure is possible in the heat exchanger on the high pressure side that this refrigerant is converted into a thermodynamic state which is below the saturation curve or boiling point curve, i.e., in the range of the coexistence of liquid and vapor and is, therefore, cooled in such a manner that the refrigerant is liquefied by the heat exchanger on the high pressure side.

In order to be able to always operate the refrigeration system according to the invention at optimum conditions, in particular, in adapting to the refrigerating capacity required, it is provided for the control to control the refrigerant compressors in accordance with the refrigerating capacity required, i.e., the refrigerant compressors can either be operated with a variable rotational speed and/or can be switched on or off.

In this respect, it is particularly expedient when the control is in a position to switch the refrigerant compressors on or off individually in accordance with the refrigerating capacity required, i.e., for it to be possible, by switching the at least two refrigerant compressors in the refrigerant circuit on or off individually, to adapt the compressor capacity to the refrigerating capacity required and, therefore, always operate the refrigeration system according to the invention in an optimum manner.

With respect to the configuration of the additional compressor stages in relation to the respective main compressor stage, no further details have so far been given. It is, for example, particularly favorable when each refrigerant compressor with additional compressor stage is dimensioned such that the mass flow of refrigerant of the additional mass flow compressed by the additional compressor stage corresponds at the most to the mass flow of refrigerant of the main mass flow compressed by the main compressor stage in this refrigerant compressor.

Furthermore, the possibilities provided by the control for adjusting the additional mass flow and the intermediate pressure may be utilized advantageously in that the refrigerant compressors with additional compressor stage are dimensioned such that the additional compressor stages of different refrigerant compressors compress different mass flows of refrigerant of the additional mass flow.

As a result, a considerable variation of the additional mass flow to be compressed can be brought about by way of a suitable selection of the additional compressor stages provided for the compression of refrigerant of the additional mass flow, in particular, by way of a suitable combination of additional compressor stages configured for different mass flows without the capacity of the main compressor stages needing to be altered for this purpose.

Since, in the case of refrigeration systems which are intended to operate in the supercritical range, a very great difference in pressure must be generated during the compression of the refrigerant, it is preferably provided for the refrigerant compressors with additional compressor stage to be reciprocating compressors.

In the case of reciprocating compressors of this type, each of the refrigerant compressors with additional compressor stage is expediently designed such that this has at least one cylinder for the additional compressor stage and at least one cylinder for the main compressor stage.

A refrigeration system of this type may be realized particularly favorably when the number of cylinders for the main compressor stage is greater than the number of cylinders for the additional compressor stage in each refrigerant compressor with additional compressor stage.

Furthermore, a solution of the refrigeration system according to the invention which is particularly favorable with respect to the variable adjustability of the additional mass flow provides, in the case of the refrigerant compressors with additional compressor stage, for the additional compressor stages of different refrigerant compressors to have a different volumetric displacement so that, as a result, a particularly broad range of volumetric displacements for the additional mass flow is also available for selection in different combinations of the additional compressor stages.

Furthermore, an additional solution which is suitable with respect to its variability provides for the ratio of the volumetric displacement of the additional compressor stage to the volumetric displacement of the main compressor stage for each refrigerant compressor with additional compressor stage to be different in relation to at least one of the other refrigerant compressors with additional compressor stage so that not only the volumetric displacements of the additional compressor stages may be combined by suitable selection and combination with one another to form as great a range of variation as possible but also the volumetric displacements of the main compressor stages.

A further, advantageous embodiment of the refrigeration system according to the invention provides for the reservoir for liquefied refrigerant to operate at an intermediate pressure in the first operating mode and for an additional expansion unit with an expansion element and a post-connected heat exchanger making refrigerating capacity available to be provided between the heat exchanger on the high pressure side which cools the refrigerant and the reservoir for liquefied refrigerant. The degree of thermodynamic effectiveness of the refrigeration system according to the invention may be improved even further with this additional expansion unit since the vaporization temperature in this additional expansion unit is higher which presupposes that the refrigerating capacity available can be used at a higher temperature level, for example, for air cooling or air conditioning.

A considerably improved degree of thermodynamic effectiveness can be achieved at supercritical operating conditions, in particular, in all the preceding embodiments. Moreover, the refrigerating capacity for a defined compressor volumetric displacement is greater and the characteristic capacity curve is flatter in relation to the surrounding temperature which has a positive effect on the regulating characteristics of the refrigeration system.

The reason for the greater cost efficiency during supercritical operation is, in particular, the fact that the vaporization of the additional mass flow is brought about at a higher level of pressure than the vaporization in the heat exchangers of the expansion units on the suction side. This leads to an improvement in the degree of thermodynamic effectiveness resulting in reduced energy requirements for a defined refrigerating capacity.

Cooling of the refrigerant of the main mass flow at saturation pressure up to the boiling point curve or saturation curve is brought about, in particular, due to the expansion of the main mass flow and of the additional mass flow in conjunction with the additional mass flow being drawn off by suction. As a result, the difference in enthalpy for the vaporization and overheating is increased. The percentage increase in the difference in enthalpy is higher than the proportion of compressor capacity which must be used for the compression of the additional mass flow. Apart from the improvement in the degree of effectiveness mentioned before, this also leads to a greater refrigerating capacity—in relation to an identical total volumetric displacement of the refrigeration system.

Furthermore, it is of advantage in the case of the refrigeration system according to the invention, in particular, when carbon dioxide is used as refrigerant when the refrigerant compressor has cylinder heads, with which inlet chambers and outlet chambers are essentially thermally decoupled so that essentially no heating up of the inlet chambers with the refrigerant to be drawn in by suction takes place as a result of the heating of the refrigerant during the compression to high pressure and the heating up of the outlet chambers connected therewith and, therefore, there is no negative influence on the compressor capacity.

In order to be able to use the additional compressor stages either for the compression of the main mass flow or for the compression of the additional mass flow it is, in principle, conceivable to provide controlled valves which supply the additional compressor stages either with refrigerant from the main mass flow or from the additional mass flow.

A solution which is particularly simple from a constructional point of view provides, however, for a check valve to be provided for connecting an inlet chamber of the additional compressor stage to the low pressure connection of the main compressor stage so that the additional compressor stage compresses refrigerant of the main mass flow automatically when the additional mass flow is interrupted.

A particularly simple solution provides in this respect for the check valve to connect the inlet chamber of the additional compressor stage to the inlet chamber of the main compressor stage.

Another advantageous solution provides for the check valve to be provided in a valve plate of the respective refrigerant compressor. This solution has the advantage that the valve plate which is already equipped with valves need merely be provided with an additional check valve and, therefore, the check valve is particularly easy to mount.

In this respect, it is particularly expedient when a connecting channel between the low pressure connection and the check valve runs in a cylinder housing and can be integrally formed in it in the same way as the inlet channel for supplying the main compressor stage with refrigerant supplied via the low pressure connection.

Additional features and advantages of the invention are the subject matter of the following description as well as the drawings illustrating several embodiments.

DETAILED DESCRIPTION OF THE INVENTION

Figure 1:
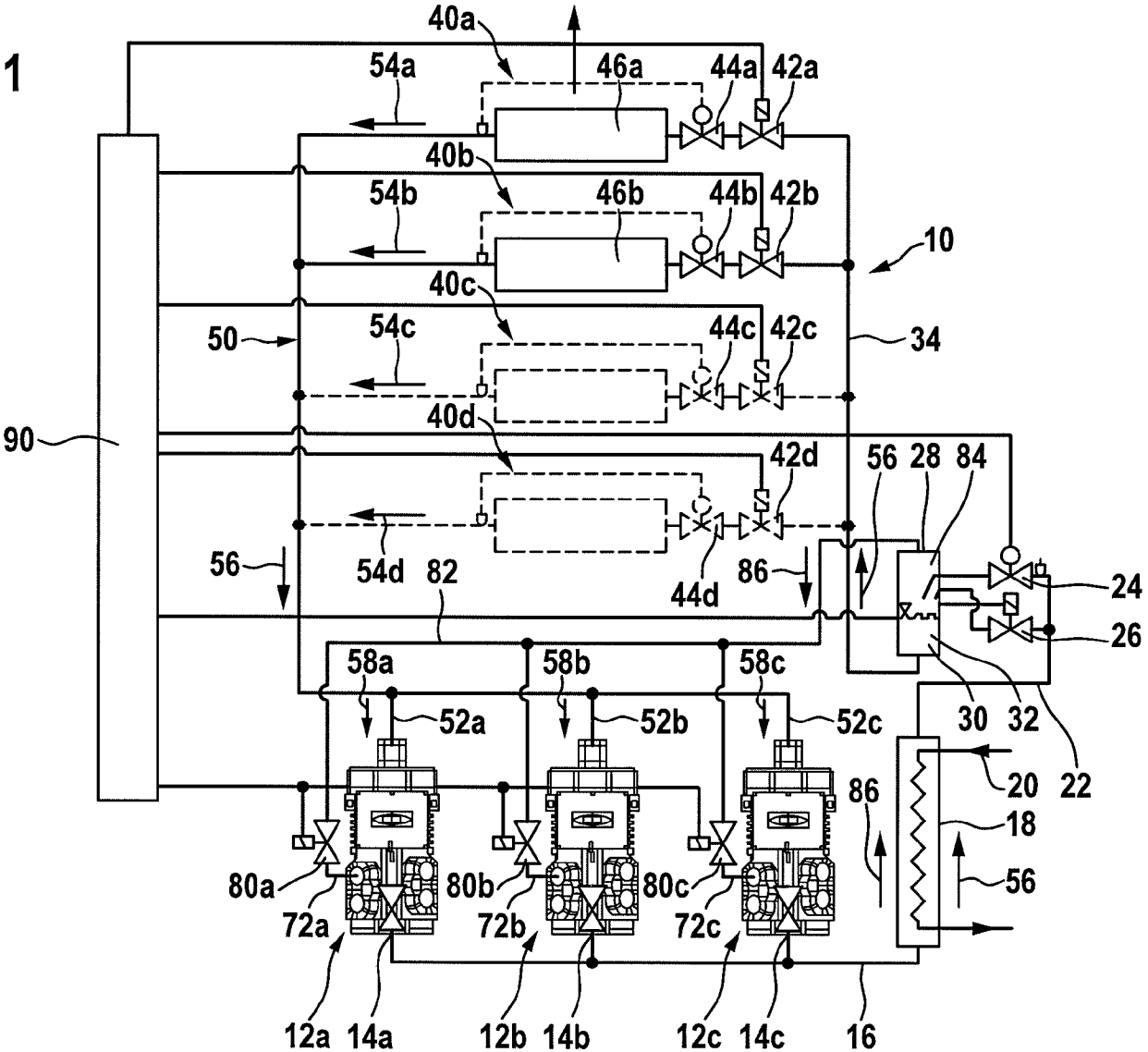
FIG. 1 shows a schematic illustration of a first embodiment of a refrigeration system according to the invention.

One embodiment of a refrigeration system illustrated in FIG. 1 comprises a refrigerant circuit which is designated as a whole as 10 and in which several, for example, three refrigerant compressors 12*a* to 12*c* are arranged, the high pressure connections 14*a* to 14*c* of which are connected to a high pressure line 16 of the refrigerant circuit 10.

The high pressure line 16 leads to a heat exchanger 18 on the high pressure side which cools the refrigerant compressed to high pressure PH, for example, with a stream 20 of cooling agent, wherein the cooling agent is preferably ambient air which flows through the heat exchanger 18.

It is, however, also conceivable to provide another cooling agent, for example, water or the like instead of ambient air.

An additional high pressure line 22 leads from the heat exchanger 18 to an expansion valve 24 and to a bypass valve 26 which is connected in parallel to the expansion valve 24, both of which open into a container 28 which is designed such that it comprises a reservoir 30 for liquid refrigerant, in which a volume 32 of liquid refrigerant is always present which—as will be described in detail in the following—represents a buffer volume for liquid refrigerant in the refrigerant circuit 10.

A line 34 leads from the reservoir 30 to expansion units 40, for example, four expansion units 40*a* to 40*d* which are connected in parallel.

The line 34 is connected to the reservoir 30 in such a manner that it conveys essentially only liquid refrigerant to the expansion units 40 and they can, therefore, be operated and, in particular, regulated in the known manner since an expansion of liquid refrigerant, essentially without any proportion of gas, always takes place.

The regulation of expansion units 40 which are supplied with liquid refrigerant corresponds to the type of regulation in the case of known refrigeration systems.

Each of the expansion units 40 comprises a stop valve 42, an expansion valve 44 which expands the liquid refrigerant and a heat exchanger 46 on the low pressure side which is in a position, on account of the expanded refrigerant, to provide refrigerating capacity, as designated by the arrow 48.

The heat exchangers 46 of the expansion units 40 connected in parallel are connected to a common low pressure line 50 which leads to low pressure connections 52*a* to 52*c* of the refrigerant compressors 12*a* to 12*c*.

The sum of all the branch mass flows 54*a*, 54*b*, 54*c* and 54*d* of the refrigerant, which pass through the expansion units 40 and are collected by the low pressure line 50, form a main mass flow 56 of the refrigerant circuit 10 which is again divided up, for its part, into branch mass flows 58*a*, 58*b* and 58*c* which are drawn in by the refrigerant compressors 12*a* to 12*c* via the lower pressure connections 52*a* to 52*c* and compressed to high pressure PH in order to exit again through the high pressure connections 14*a* to 14*c* of the refrigerant compressors 12.

Since the branch mass flows 54*a* to 54*d* have been removed from the line 34, the main mass flow 56 also flows through the line 34 following the reservoir 30 and is then allotted again to the branch mass flows 54*a* to 54*d*.

Figure 2:
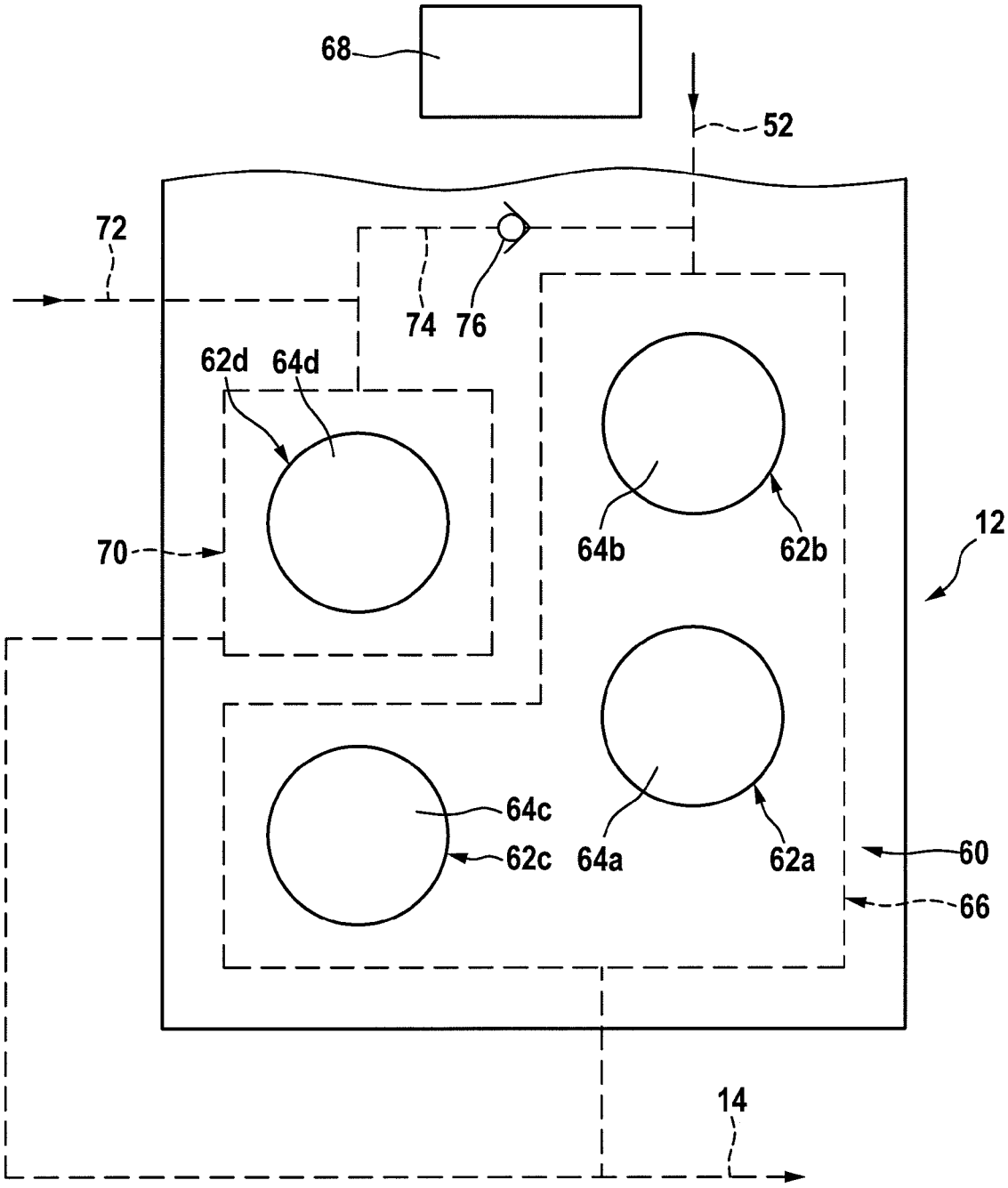
FIG. 2 shows a schematic illustration of one of the refrigerant compressors used in the refrigeration system according to the invention in accordance with the first embodiment and comprising main compressor stage and additional compressor stage.

As illustrated in FIG. 2, each of the refrigerant compressors 12 is designed, for example, as a reciprocating compressor and comprises a cylinder housing 60, in which altogether four cylinders 62*a* to 62*d* are, for example, provided, in which refrigerant can be compressed by means of pistons 64*a* to 64*d* moved oscillatingly.

In a refrigerant compressor 12 designed in such a manner in accordance with the invention, not all the cylinders 62*a* to 62*d* operate as a uniform compressor stage but rather the cylinders 62*a* to 62*c* are, for example, combined to form a main compressor stage 66, in which these three cylinders 62*a* to 62*c* operate in parallel, i.e., all three cylinders 62*a* to 62*c* draw in refrigerant via the respective low pressure connection 52 and deliver refrigerant compressed to high pressure PH to the respective high pressure connection 14.

Furthermore, the cylinder 62*d*, which is driven by a drive motor 68 together with the remaining cylinders of the main compressor stage 66 and in the same way as them, is operated as a separate additional compressor stage 70 which is likewise connected to the high pressure connection 14 on the output side but is in a position to draw in refrigerant either via an additional connection 72 or via the low pressure connection 52.

In the simplest case, a check valve 76 is provided in the connecting channel 74 running between the additional connection 72 and the low pressure connection 52 and this blocks the connecting channel 74 when the pressure at the additional connection 72 is higher than that at the low pressure connection 52 and so the connecting channel 74 is blocked when refrigerant is present at the additional connection 72 at a higher pressure than at the lower pressure connection 52 and, therefore, the additional compressor stage 70 draws in refrigerant via the additional connection 72. A controlled valve can, however, also be provided.

If, however, the additional connection 72 is closed or blocked so that no refrigerant can be drawn in via this connection, the check valve 76 opens and the additional compressor stage 70 draws in refrigerant via the lower pressure connection 52 and compresses this to high pressure PH in the same way as the main compressor stage 66.

As illustrated in FIG. 1, the additional connections 72*a* to 72*c* of the refrigerant compressors 12*a* to 12*c* are each connected via stop valves 80*a* to 80*c* to a distributor line 82 which opens into the container 28, namely such that it is in a position to discharge vaporized refrigerant out of a vapor chamber 84 of the container 28.

The vaporized refrigerant discharged by the distributor line 82 from the container 28 forms an additional mass flow 86 which can be distributed by the distributor line 82 to the additional compressor stages 70 in order to be compressed by them to high pressure PH.

The additional mass flow 86 can therefore be controlled due to the fact that individual ones of the stop valves 80*a* to 80*c* are opened or closed.

For the purpose of controlling the refrigeration system, a control designated as 90 is provided altogether and this is in a position to activate the individual stop valves 80*a* to 80*c* individually.

If all the stop valves 80*a* to 80*c* are closed, no additional mass flow 86 flows through the distributor line 82 and no compression of an additional mass flow 86 takes place in the additional compressor stages 70 and so only the main mass flow 56 is compressed and expanded altogether in the refrigerant circuit 10 with all the cylinders 62.

If, however, one of the stop valves 80*a* to 80*c* is open or all the stop valves 80*a* to 80*c* are open, the additional mass flow 86 flows through the distributor line 82, is supplied to the additional compressor stages 70 which are connected to the distributor line 82 via the opened stop valves 80*a* to 80*c* and is, therefore, compressed by the corresponding additional compressor stages 70 of the respective refrigerant compressors 12 such that the additional mass flow 86 flows not only through the high pressure line 16 but also through the heat exchanger 18 on the high pressure side in addition to the main mass flow 56 and is supplied to the container 28 via the additional high pressure line 22, wherein a separation takes place between the main mass flow 56 and the additional mass flow 86 in the container 28 to the effect that the main mass flow 56 is supplied to the expansion units 40 via the line 34 whereas the additional mass flow 86 is supplied to the corresponding additional compressor stages 70 via the distributor line 82 and does not, therefore, flow through the expansion units 40.

A refrigeration system designed in this way may be operated as follows with, in particular, carbon dioxide ($CO_2$) used as refrigerant:

If an adequately vigorous cooling of the refrigerant, which has been compressed to high pressure PH, in the heat exchanger 18 on the high pressure side is possible, the refrigeration system may be operated in the so-called subcritical cyclic process. With carbon dioxide as refrigerant, this presupposes that the temperature of the cooling agent 20 supplied to the heat exchanger 18 on the high pressure side is in the order of magnitude of approximately 23° C. or below. In this case, the cooling of the refrigerant compressed to high pressure PH leads to a liquefying thereof and so the bypass valve 26 is opened by the control 90 and the liquid refrigerant is supplied directly to the reservoir 30 for liquid refrigerant from the additional high pressure line 22.

This liquid refrigerant then forms the main mass flow 56 which is distributed to the individual expansion units 40 via the line 34 insofar as they have been switched on by the control 90, i.e., the stop valves 42*a* to 42*d* are open.

The activation of the individual expansion units 40*a* to 40*d* is brought about irrespective of whether or not refrigerating capacity 48 is intended to be made available in the area of the respective heat exchanger 46 on the low pressure side.

The refrigerant expanded in the individual expansion units 40*a* to 40*d* is then supplied to the individual low pressure connections 52*a* to 52*c* of the individual refrigerant compressors 12*a* to 12*c* via the low pressure line 50.

The control 90 does not necessarily operate all the refrigerant compressors 12*a* to 12*c* in the full load range but rather can operate either individual ones of the refrigerant compressors 12*a* to 12*c* in the full load range or individual ones or all of the refrigerant compressors 12*a* to 12*c* in the partial load range, i.e., with a reduced rotational speed of the respective drive motor 68. It is, however, also possible to switch off individual ones of the refrigerant compressors 12*a* to 12*c* completely on the part of the control 90, for example, when only some of the expansion units 40*a* to 40*d* are intended to have refrigerating capacity made available at their respective heat exchanger 46.

Moreover, the control closes the stop valves 80*a* to 80*c* in the subcritical range so that the additional compressor stages 70 of all the refrigerant compressors 12*a* to 12*c* draw in refrigerant from the main mass flow 56 via the respective check valve 76 and compress it to high pressure PH.

Figure 3:
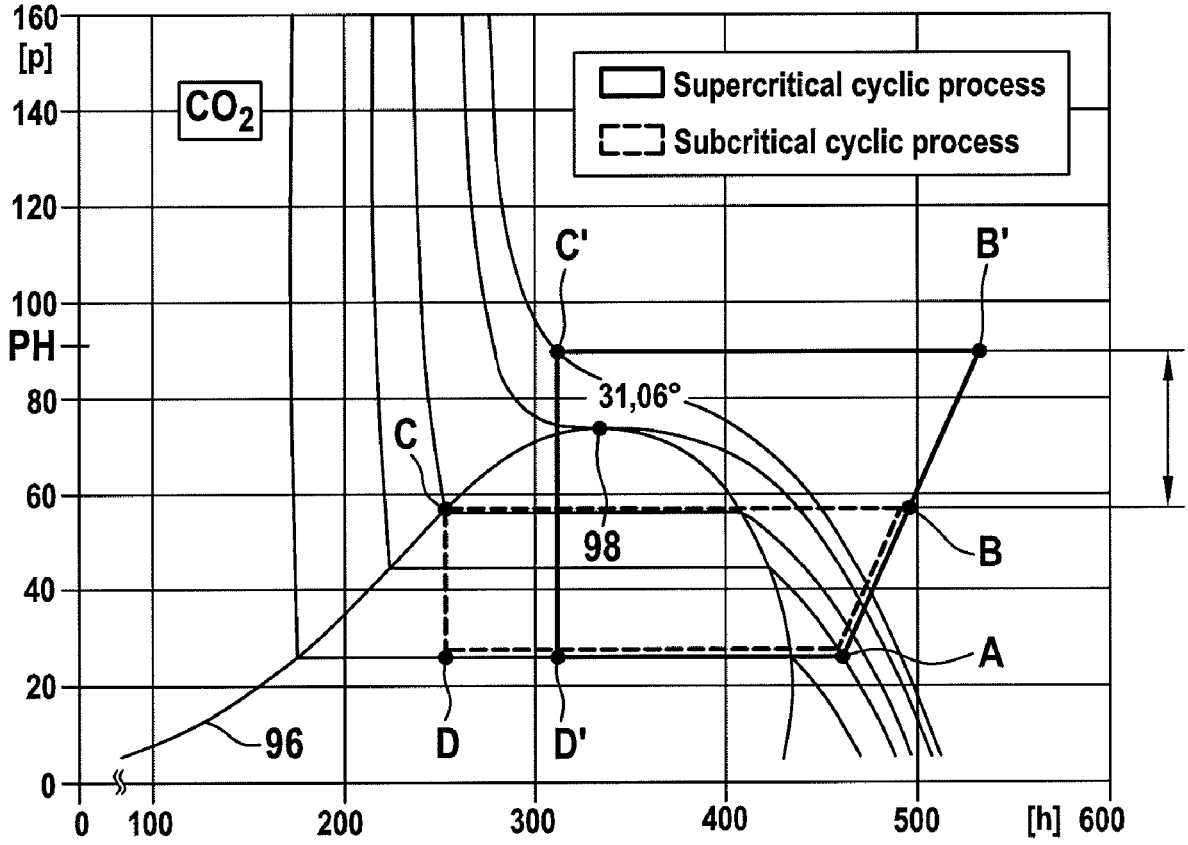
FIG. 3 shows an illustration of the pressure [P] over the enthalpy [h] in the case of a subcritical cyclic process which can be realized with the first embodiment and a possible supercritical cyclic process not, however, corresponding to the invention.

Such a cyclic process for the subcritical operation is illustrated in FIG. 3 by the dashed lines, wherein the state at point A represents the beginning of compression of refrigerant from the main mass flow 56 by the respective refrigerant compressor 12 which is terminated at the state at point B.

Proceeding from the state at point B, the refrigerant compressed at high pressure PH is cooled as far as a state at point C which is approximately on the saturation curve or boiling point curve 96 for carbon dioxide as refrigerant.

This refrigerant which is now cooled but liquefied in the heat exchanger 18 can now be supplied in this state to the individual expansion units 40, wherein an isenthalpic expansion of the refrigerant takes place as a result of the expansion valve 44 of each of the expansion units 40 which leads to a reduction in the pressure combined with a reduction in the temperature and so the state at point D in FIG. 3 is reached.

Proceeding from the state at point D, the refrigerating capacity 48 can now be made available in the respective heat exchanger 46 on the low pressure side as a result of an increase in enthalpy until the state at point A is again reached which, with respect to enthalpy and pressure, represents the refrigerant which is supplied to the low pressure connections 52 of the refrigerant compressors 12 via the low pressure line 50.

If no cooling agent is, however, available which is a position to cool the refrigerant to a temperature in the order of magnitude of 23° C. but rather the cooling agent available is one which merely allows cooling to higher temperatures of the refrigerant, for example, over 31°, only a so-called supercritical cyclic process (illustrated in FIG. 3 by solid lines) would be possible with the refrigeration system according to FIG. 1, with an open bypass valve 26 and inoperative expansion valve 24; with this process the refrigerant would have had to be compressed to a higher pressure in accordance with the state at point B' in FIG. 3, wherein a subsequent cooling in the heat exchanger 18 on the high pressure side leads to a state at point C' in FIG. 3 which is outside the saturation curve 96.

The refrigerant in the state at point C' in FIG. 3 is still gaseous. A subsequent, isenthalpic expansion of the refrigerant in the individual expansion units 40 would then lead to the state at point D' in FIG. 3, wherein the consequence of this would be the fact that gaseous refrigerant would be supplied to the expansion valves 44 of the expansion units 40 and gaseous refrigerant would have to be expanded. Such an expansion of a gaseous refrigerant is subject to different regulating characteristics and so, as a result, the regulating characteristics known so far for the expansion valves 44 are not suitable.

Figure 4:
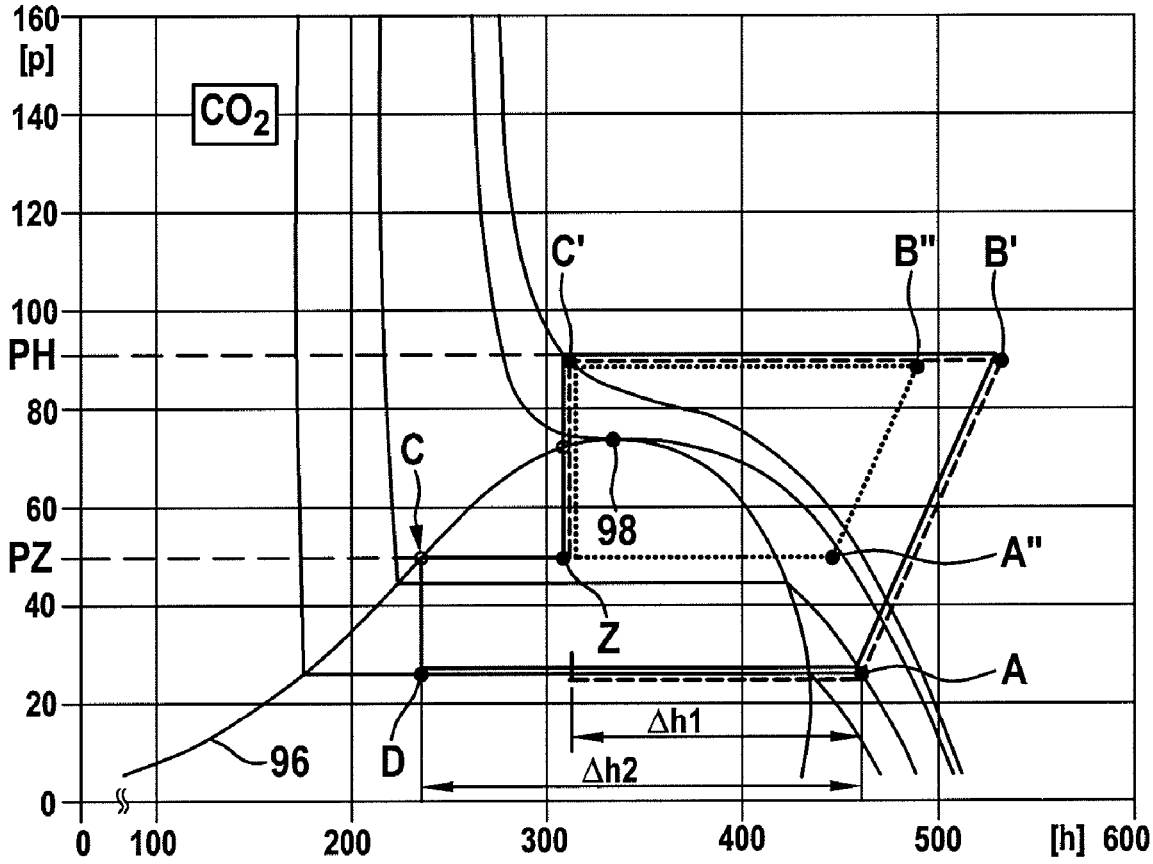
FIG. 4 shows an illustration of the pressure [P] over the enthalpy [h] in the case of a cyclic process according to the invention which can be carried out with the first embodiment of the solution according to the invention in the supercritical range with expansion of the refrigerant compressed to high pressure to an intermediate pressure and simultaneous reduction of the enthalpy due to an additional mass flow being drawn off by suction.

For this reason, no supercritical cyclic process from point A to B' to C' and D' and then again to A, as illustrated in FIG. 3, takes place during supercritical operation of the refrigeration system but rather the bypass valve 26 is closed by the control 90 and the expansion valve 24 is activated so that the refrigerant entering the container 28 from the additional high pressure line 22 can be expanded by the expansion valve 24 to an intermediate pressure PZ in accordance with the state Z in FIG. 4. In this respect, the temperature may be reduced, in addition, in the case of the intermediate pressure PZ due to vaporization of refrigerant to such an extent, and, therefore, the enthalpy also be reduced, that liquid refrigerant of the main flow 56, the state of which corresponds to the state at point C on the boiling point curve 96 in FIG. 4, is present in the container 28.

In order to be able to arrive at the state at point C from the state at point C' in FIG. 4, it is necessary to predetermine the intermediate pressure PZ in the container 28 and to stabilize this intermediate pressure PZ by drawing off the vaporized refrigerant, wherein the vaporized refrigerant results in the additional mass flow 86 which must be discharged from the vapor chamber 84 of the container in order to be able to keep the intermediate pressure PZ at the desired level.

The state at point C is at a value of the enthalpy [h] which is lower by more than 20% in relation to a maximum 98 of the boiling point curve 96 and which is reached due to the vaporization of the refrigerant forming the additional mass flow, wherein the state at point C in FIG. 4 is either essentially on the boiling point curve 96 or, where applicable, in the case of additional cooling, e.g., via a heat exchanger which has expanded main mass flow passing through it at a somewhat lower enthalpy than the enthalpy of the state at point C.

For this purpose, the control 90 must open at least some of the stop valves 80*a* to 80*c* or all the stop valves 80*a* to 80*c* in order, as a result, to cause refrigerant to be drawn in from the additional flow 86 by the additional compressor stages 70 in order to maintain the intermediate pressure PZ in the container 28 and to be compressed to high pressure PH.

As a result, the refrigerant of the main mass flow 56 may be supplied to the individual expansion units 42*a* to 42*c* via the line 34 and converted, due to isenthalpic expansion in the expansion units 40 by means of the expansion valves 44, into the state designated in FIG. 4 as point D, in which the output of refrigerating capacity 48 is possible with an increase in enthalpy up to the state at point A in the respective heat exchanger 46 on the low pressure side, wherein it is apparent in a comparison with FIG. 3 that the refrigerating capacity available is greater than in a supercritical cyclic process in accordance with the states at points A, B', C', D' in FIG. 3.

The advantage of the idea according to the invention is to be seen in the fact that it is possible to select the high pressure PH in an optimum manner in accordance with the course of the isotherms of the refrigerant used without the subsequent expansions needing to be taken into consideration.

Furthermore, the intermediate pressure PZ may likewise be optimized by way of suitable variation of the additional mass flow, namely such that the percentage reduction in the enthalpy of the main mass flow is higher than the proportion of displacement capacity which is required for the additional mass flow in the total displacement capacity of the compressor and so the losses with respect to displacement capacity caused by compression of the additional mass flow are overcompensated by the reduction in the enthalpy of the main mass flow.

The cyclic process carried out for maintaining the intermediate pressure PZ as a result of compression of the additional mass flow 86 is illustrated in FIG. 4 by dashed lines and extends from the state at point Z as a result of an increase in enthalpy of the vaporized refrigerant to the state at point A" and from the state at point A" to the state at point B" which is, again, at the high pressure PH and from the state at point B" to the state at point C' and from the state at point C' to the state at point Z.

In the case of such a supercritical cyclic process, as illustrated in FIG. 4, between the states at the points A, B', C', C and D, the additional mass flow 86 which occurs is not constant in relation to the main mass flow 56 when the intermediate pressure PZ is intended to be adjusted in an optimized manner but varies depending on how many expansion units 40 are activated in the refrigerant circuit 10 and depending on how high the temperature of the cooling agent 20 is which is supplied to the heat exchanger 18 on the high pressure side.

In order to have an intermediate pressure PZ corresponding to optimized operating conditions with the most varied of operating conditions and, consequently, to be able to compress an additional mass flow 86 maintaining this intermediate pressure PZ via the additional compressor stages 70, the additional compressor stages 70 of the refrigerant compressors 12 are designed in such a manner that an optimized supercritical operation is still possible with a maximum output of refrigerating capacity by all the expansion units 40 and with a maximum temperature of the cooling agent 20 and the additional mass flow 86 thereby resulting can be compressed to high pressure PH by the entirety of the active additional compressors stages 70 to maintain a suitable level of the intermediate pressure PZ.

If more favorable operating conditions are present, proceeding from this operating state, the control 90 can either reduce the rotational speed of the drive motors 68 of one or more of the refrigerant compressors 12 or switch off one of the refrigerant compressors 12, wherein, as a result, not only the compressor capacity of the main compressor stage of this refrigerant compressor 12 is dispensed with but also the compressor capacity of the additional compressor stage 70.

If, however, the operating conditions change to the extent that, for example, cooling agent 20 with a lower temperature is available, the additional mass flow 86 is altered since less refrigerant has to be vaporized in order to obtain liquid refrigerant in the state at point C according to FIG. 4 at a suitable intermediate pressure PZ.

In this case, the control 90 has the possibility of adapting the compressor capacity of the additional compressor stages 70 to the smaller additional mass flow 86 required by closing one or two of the stop valves 80*a* to 80*c* and, therefore, of maintaining an optimized intermediate pressure PZ in the container 28.

The additional compressor stages 70, the stop valves 80 of which have been closed, then draw in refrigerant of the corresponding low pressure connection 52 and, therefore, compress refrigerant from the respective main mass flow 56.

The idea according to the invention therefore allows an optimum adaptation of the intermediate pressure PZ by adapting the compressor capacity of the additional compressor stages 70*a* to 70*c* required for the compression of the additional mass flow 86 independently of the compressor capacity of the main compressor stages 66.

In principle, it would be possible to design the refrigerant compressors 12*a* to 12*c* in an identical manner so that each main compressor stage 66 and each additional compressor stage 70 can generate the same compressor capacity.

It is, however, even more advantageous for the adaptation to different operating conditions when the refrigerant compressors 12*a* to 12*c* are designed such that, for example, a second one of the refrigerant compressors 12*a* to 12*c* has double the compressor capacity of the first refrigerant compressor and a third refrigerant compressor double the compressor capacity of the second refrigerant compressor, wherein the doubling of the compressor capacity relates not only to the main compressor stages 66 but also the additional compressor stages 70.

As a result, it is possible to obtain different multiples of the compressor capacity of the first refrigerant compressor as a result of different combinations of the first, second and third refrigerant compressors, for example, double the compressor capacity of the first refrigerant compressor solely by operating the second refrigerant compressor, treble the compressor capacity of the first refrigerant compressor by operating the first and second refrigerant compressors, four times the refrigerating capacity by operating the third refrigerant compressor and five times the refrigerating capacity by operating the third refrigerant compressor in combination with the first refrigerant compressor as well as seven times the compressor capacity by a combination of the first, second and third refrigerant compressors.

With respect to the compressor capacity of the additional compressor stages 70, additional possibilities for variation are also conceivable, namely to the extent that, for example, the maximum capacity of the additional compressor stages 70 for the additional mass flow 86 is available and this corresponds to seven times the compressor capacity of the first refrigerant compressor when all three refrigerant compressors 12*a* to 12*c* are operated.

It is, however, also conceivable to use optional, whole number multiples of the compressor capacity of the additional compressor stage 70 of the first refrigerant compressor with analogous use of the procedure described above by opening stop valves 80 and connecting the individual additional compressor stages 70 of the individual refrigerant compressors 12 to the distributor line 82 for the purpose of compressing the additional mass flow 86.

Figure 5:
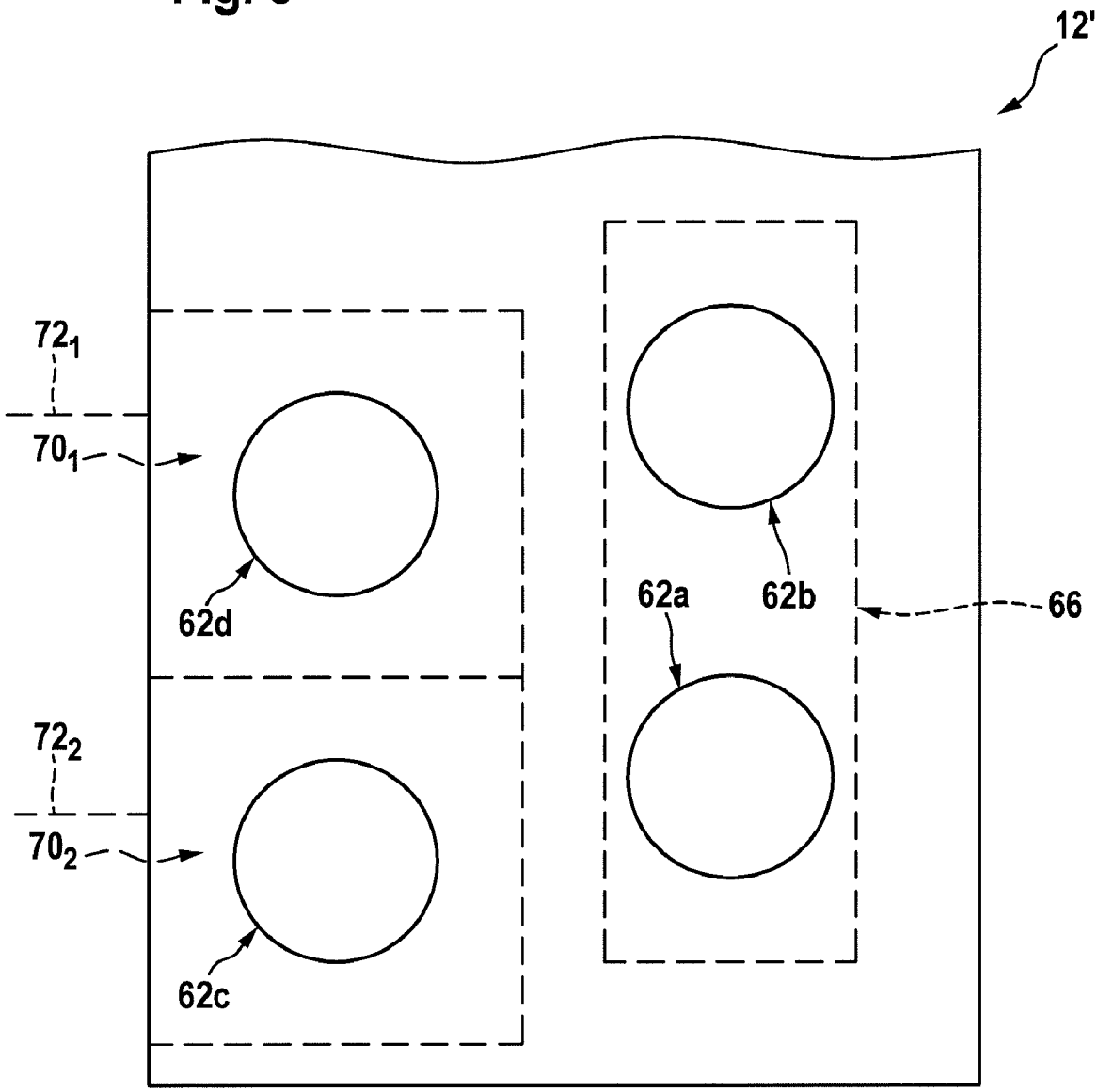
FIG. 5 shows a schematic illustration of a refrigerant compressor in a second embodiment of the refrigeration system according to the invention.

In a second embodiment of a refrigeration system according to the invention, illustrated in FIG. 5, the refrigerant compressors 12' are designed, for example, such that they have two additional compressor stages $\mathbf{70}_1$ and $\mathbf{70}_2$ which each have their own additional connections $\mathbf{72}_1$ and $\mathbf{72}_2$.

For example, the cylinder 62*c* forms the additional compressor stage $\mathbf{70}_2$ and the cylinder 62*d* the additional compressor stage $\mathbf{70}_1$ while the cylinders 62*a* and 62*b* form the main compressor stage 66.

Such a construction of one of the refrigerant compressors 12 or all the refrigerant compressors 12 creates an even greater variability with respect to the compressor capacity available for the compression of the additional mass flow 86 since the individual additional compressor stages $\mathbf{70}_1$ and $\mathbf{70}_2$ can be selectively connected to the distributor line 82 individually or together by opening the corresponding stop valves 80 or can be used for the purpose of compressing refrigerant of the main mass flow 56.

As for the rest, the second embodiment of the refrigeration system according to the invention corresponds to the first embodiment and so reference can be made in full to the description of the first embodiment of the refrigeration system according to the invention.

Figure 6:
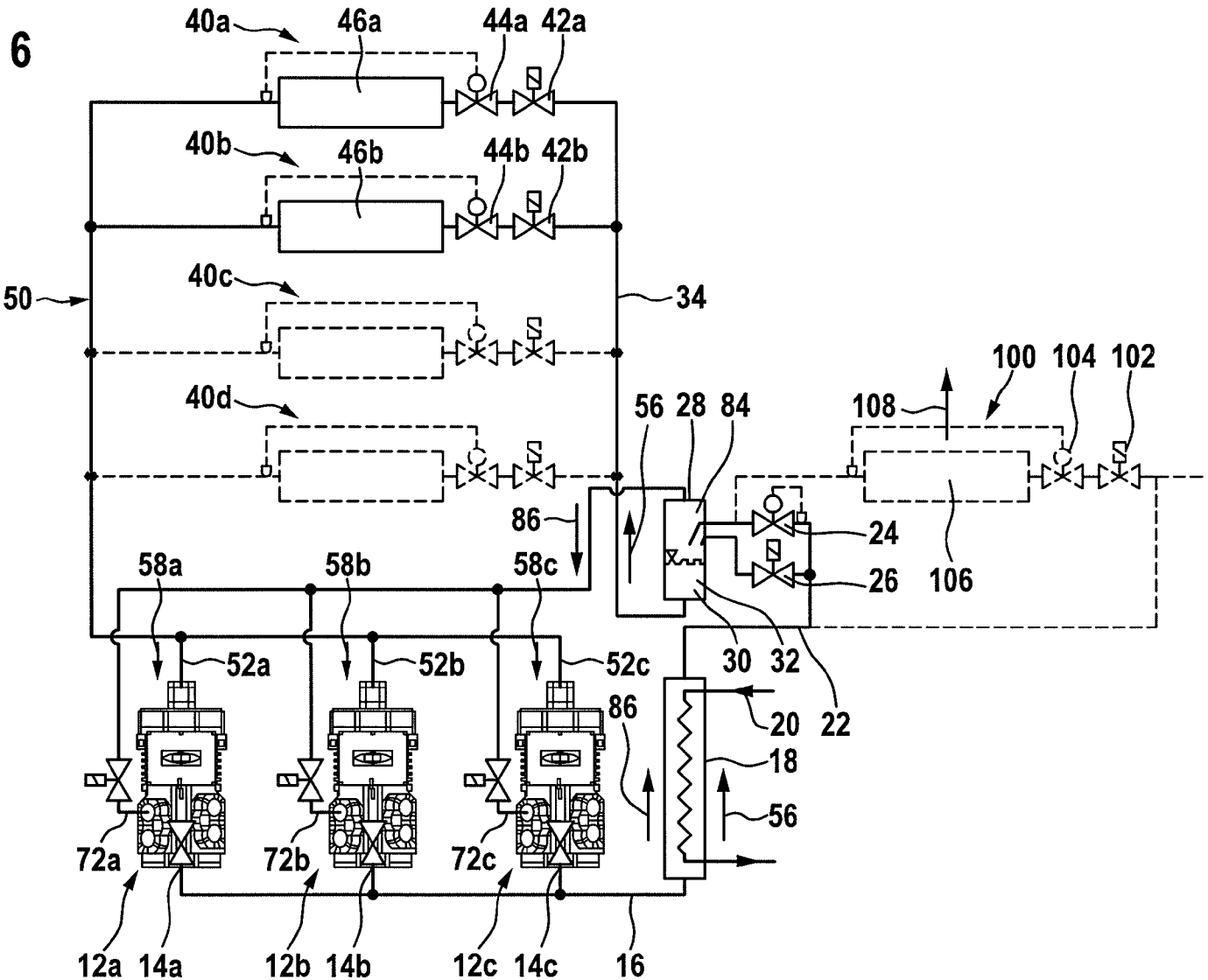
FIG. 6 shows a schematic illustration of a third embodiment of a refrigeration system according to the invention.

A third embodiment of the refrigeration system according to the invention, illustrated in FIG. 6, is also based on the first embodiment of the refrigeration system according to the invention, wherein the same parts are given the same reference numerals and so with respect to the description thereof reference is made in full to the comments on the first embodiment.

In the third embodiment, an additional expansion unit 100 is connected in parallel to the bypass valve 26 and the expansion valve 24.

The additional expansion unit 100 comprises, for its part, a stop valve 102, an expansion valve 104 and a heat exchanger 106 on the high pressure side, from which refrigerating capacity can be discharged, as designated by an arrow 108.

It is likewise possible with this additional expansion unit to expand refrigerant from the high pressure line 22 and, therefore, to obtain refrigerating capacity 108 which is available externally, wherein the refrigerant is merely expanded to the intermediate pressure PZ present in the container 28.

It is, therefore, possible to operate a heat exchanger 106 working at a higher temperature level, in addition, during supercritical operation and, as a result, increase the degree of efficiency of the refrigeration system.

The refrigerant expanded in the additional expansion unit 100 does not, however, bring about any cooling effect for the main mass flow 56 and must be discharged via the additional mass flow 86 and be compressed again by the additional compressor stages 70.

As for the rest, the third embodiment of the refrigeration system according to the invention functions in a similar way to the first embodiment and so with respect to its functioning reference is also made in full to the first embodiment.

With respect to the construction of the refrigerant compressors, no further details have so far been given. Conventional reciprocating compressors can, for example, be used as refrigerant compressors.

Figure 7:
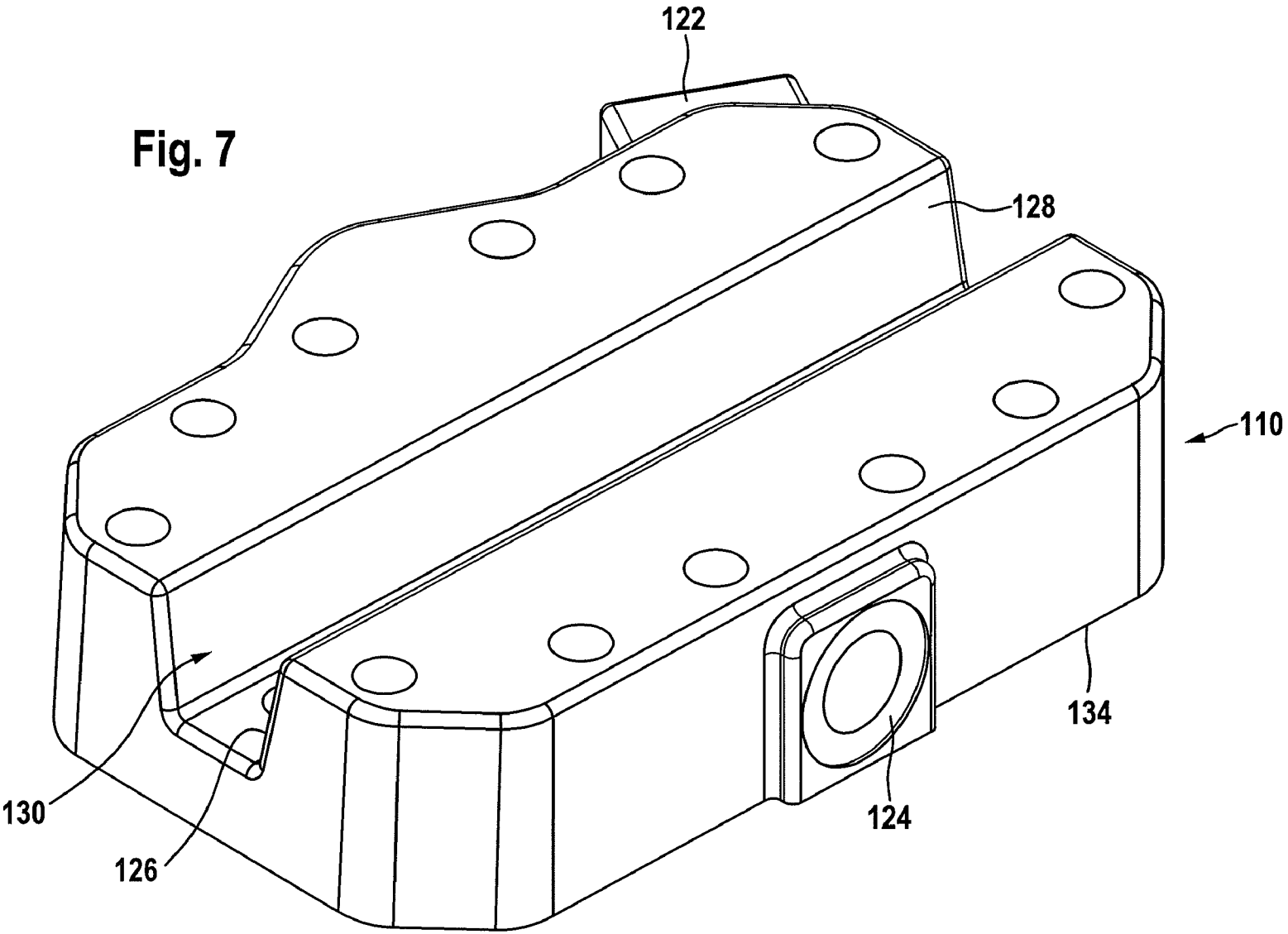
FIG. 7 shows a perspective illustration of a cylinder head of a first, preferred embodiment of a refrigerant compressor for a refrigeration system according to the invention.
Figure 8:
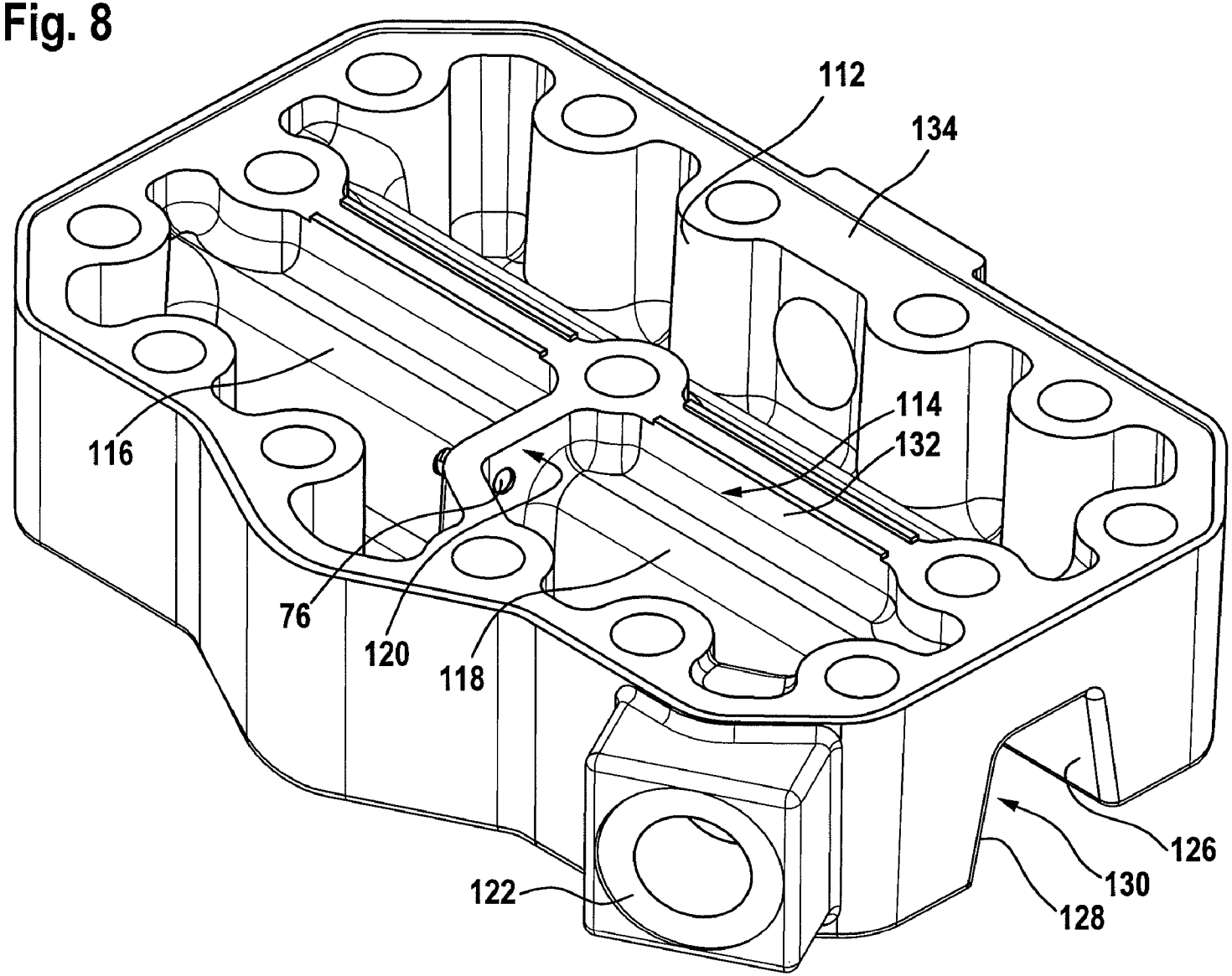
FIG. 8 shows a perspective view of the cylinder head according to FIG. 7 with an underside thereof pointing upwards.

It is particularly advantageous when, in a first preferred embodiment of such a refrigerant compressor, a cylinder head 110 as illustrated in FIGS. 7 and 8 is used and this is configured in this case for two cylinders and has an outlet chamber 112 as well as a first inlet chamber 116 and a second inlet chamber 118 which are separated from the outlet chamber 112 by a wall area 114 and, for their part, are again separated by an intermediate wall 120.

The inlet chamber 116 is associated with one cylinder 62 of the main compressor stage 66 while the inlet chamber 118 is associated with the cylinder 62 of the additional compressor stage 70.

For this reason, the inlet chamber 118 is also provided directly with a connection flange 122 for the additional connection 72 while the inlet chamber 116 is supplied with the refrigerant via the normal inlet channels provided in the housing.

In addition, the outlet chamber 112 is also provided with a connection flange 124 for the high pressure connection 14.

In order to heat the refrigerant to be drawn into the inlet chambers 116 and 118 as little as possible by the refrigerant flowing into the outlet chamber 112 in a refrigerant compressor according to the invention, the wall area 114 which separates the outlet chamber 112 from the inlet chambers 116 and 118 is formed by two walls 126 and 128 which extend separately from one another over substantial areas of the height of the cylinder head 110 and between which a free space 130 is provided which insulates the walls 126 and 128 relative to one another and, therefore, also insulates the outlet chamber 112 thermally in relation to the inlet chambers 116 and 118.

The two walls 126 and 128 are merely united essentially in a wall area 132 which borders directly on a base surface 134 of the cylinder head 110.

The check valve 76 may preferably be arranged in the intermediate wall 120 and therefore allows refrigerant to be drawn in from the inlet chamber 116 in a simple manner when the inlet chamber 118 of the additional compressor stage 70 is not supplied with refrigerant via the additional connection 72.

Figure 9:
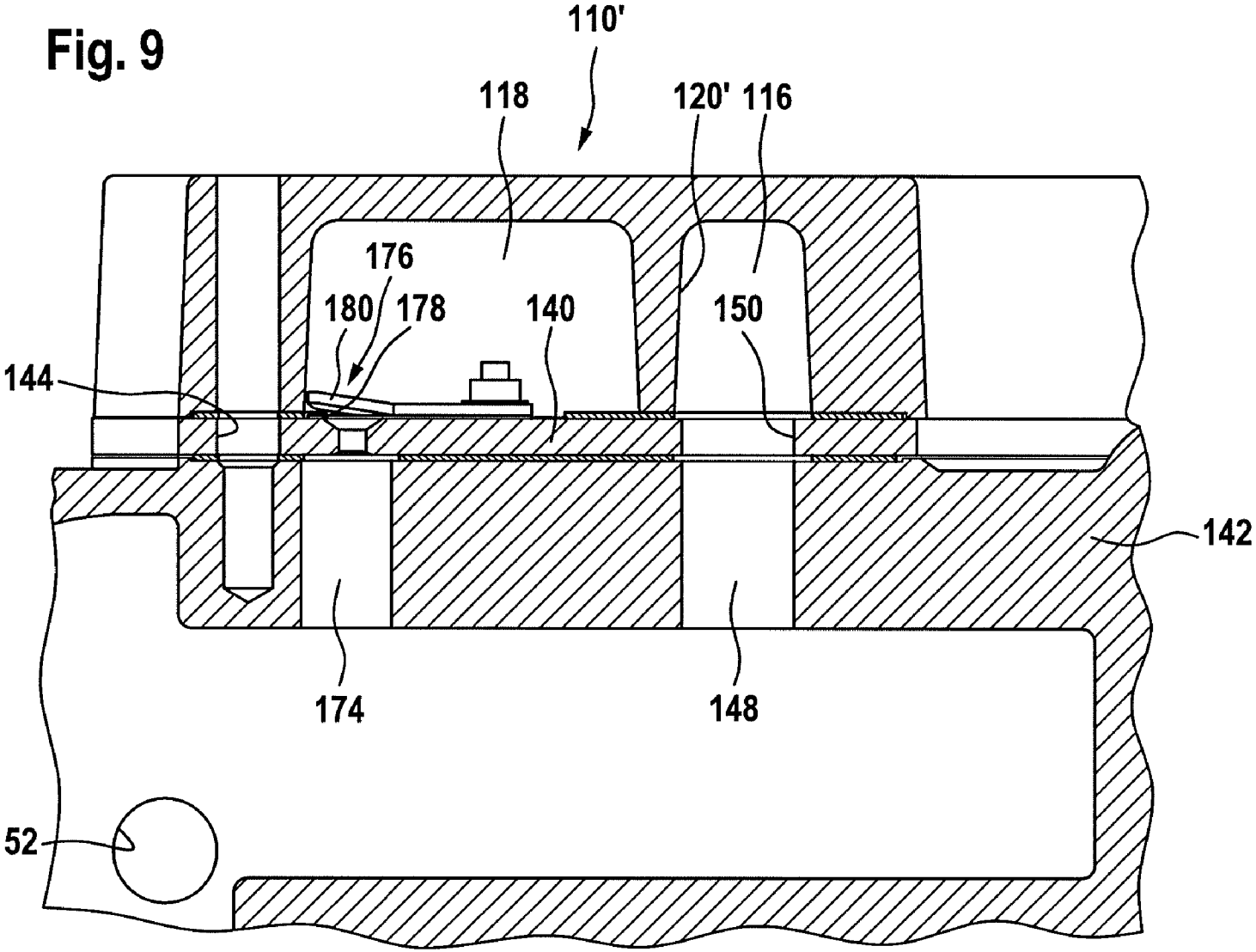
FIG. 9 shows a partial section through a second, preferred embodiment of a refrigerant compressor for the refrigeration system according to the invention.
Figure 10:
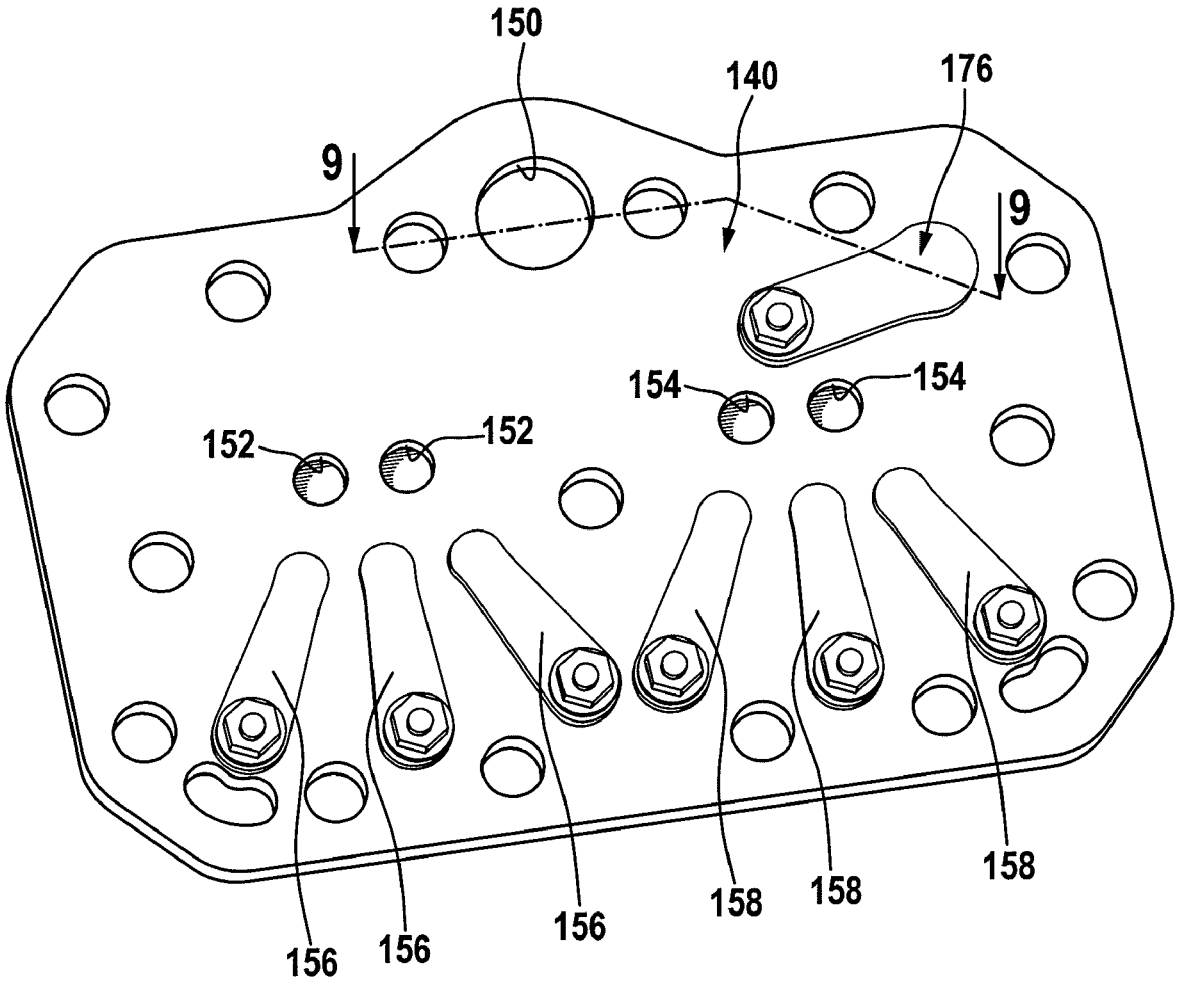
FIG. 10 shows a perspective illustration of a valve plate of the second, preferred embodiment of the refrigerant compressor according to FIG. 9.

In a second, preferred embodiment of a refrigerant compressor according to the invention, illustrated in FIGS. 9 and 10, the intermediate wall 120' of the cylinder head 110' is not provided with the check valve 76 but rather a check valve 176 is provided on a valve plate 140 which rests on a cylinder housing 142 and bears, for its part, the cylinder head 110'.

For this purpose, an additional opening 144 is provided in the valve plate 140 and this opening is arranged so as to be congruent with a connecting channel 174, which is provided in the cylinder housing 142 and branches off from the inlet channel 148, and opens into the inlet chamber 118 for the cylinder 62 of the additional compressor stage 70.

The opening 144 can be closed by a valve tongue 178 of the check valve 176 which is arranged on a side of the valve plate 140 facing the inlet chamber 118 and is secured, in addition, by a catcher element 180.

The inlet chamber 116 of the main compressor stage 66 is provided with refrigerant supplied to the low pressure connection 52 via an inlet channel 148, wherein an opening 150 is provided in the valve plate 140 which is arranged so as to be congruent with the inlet channel 148 and via which the refrigerant transfers from the inlet channel 148 into the inlet chamber 116.

As a result, it is possible in a simple manner, as illustrated in FIG. 10, not only to assign inlet valves, which are not, however, immediately visible in FIG. 10 and are associated with inlet openings 152 of the main compressor stage 66 and inlet openings 154 of the additional compressor stage 70, to the valve plate 140 and, in addition, to arrange the corresponding outlet valves 156 and 158 on the valve plate 140 but also to provide the check valve 176 in the same way and preferably with the same construction as the outlet valves 156 and 158 so that this check valve can be mounted in a simple manner and can also be optimized in the same way as the outlet valves 156 and 158 with respect to its valve characteristics.

The invention claimed is:

1. Refrigeration system comprising a refrigerant circuit, a main mass flow of a refrigerant being guided in said circuit, a refrigerant-cooling heat exchanger arranged in the refrigerant circuit on the high pressure side, an expansion cooling device arranged in the refrigerant circuit, said device cooling the main mass flow of the refrigerant in the active state and thereby generating an additional mass flow of gaseous refrigerant, a reservoir for liquefied refrigerant arranged in the refrigerant circuit, at least one expansion unit for liquefied refrigerant of the main mass flow, said expansion unit being arranged in the refrigerant circuit and having an expansion element and a post-connected heat exchanger on the low pressure side, said heat exchanger making refrigerating capacity available, and at least one refrigerant compressor arranged in the refrigerant circuit, said compressor having a main compressor stage and at least one additional compressor stage driven together with the main compressor stage, said two stages compressing refrigerant to high pressure PH, wherein the main compressor stage and the at least one additional compressor stage are adapted to be used such that either the main compressor stage compresses refrigerant from the main mass flow and the additional compressor stage compresses refrigerant from the additional mass flow or the main compressor stage and the additional compressor stage compress refrigerant from the main mass flow, at least two refrigerant compressors being arranged in the refrigerant circuit, said compressors being adapted to be switched on individually for the purpose of compressing the main mass flow, at least two of the refrigerant compressors each have at least one additional compressor stage, wherein each of the additional compressor stages is adapted to be used optionally for the compression of refrigerant from the main mass flow or for the compression of refrigerant from the additional mass flow and a control provided for switching in a first operating mode as a function of the operating conditions on such a number of additional compressor stages for the compression of refrigerant from the additional mass flow that the expansion cooling device liquefies the main mass flow and reduces its enthalpy.

2. Refrigeration system as defined in claim 1, wherein the expansion cooling device reduces the enthalpy of the main mass flow by at least 10%.

3. Refrigeration system as defined in claim 2, wherein the expansion cooling device reduces the enthalpy of the main mass flow by at least 20%.

4. Refrigeration system as defined in claim 1, wherein the first operating mode corresponds to a supercritical operation.

5. Refrigeration system as defined in claim 1, wherein the expansion cooling device converts the main mass flow into a thermodynamic state, the pressure and enthalpy values of said state being lower than those of a maximum of the saturation curve.

6. Refrigeration system as defined in claim 5, wherein the pressure and enthalpy values of the main mass flow brought about by the expansion cooling device are close to the saturation curve of the enthalpy/pressure diagram.

7. Refrigeration system as defined in claim 6, wherein the pressure and enthalpy values of the main mass flow brought about by the expansion cooling device are essentially on the saturation curve of the enthalpy/pressure diagram.

8. Refrigeration system as defined in claim 1, wherein the expansion cooling device has an expansion valve for the expansion of refrigerant to an intermediate pressure PZ and wherein the intermediate pressure PZ of the expansion cooling device is adjustable by switching on the suitable number of additional compressor stages.

9. Refrigeration system as defined in claim 8, wherein the expansion valve expands refrigerant of the main mass flow and refrigerant of the additional mass flow to the intermediate pressure PZ.

10. Refrigeration system as defined in claim 8, wherein the expansion cooling device also comprises the reservoir for the liquid refrigerant of the main mass flow.

11. Refrigeration system as defined in claim 1, wherein in the second operating mode the expansion cooling device is in the inactive state and brings about no cooling of the main mass flow.

12. Refrigeration system as defined in claim 1, wherein in the second operating mode all the additional compressor stages compress refrigerant of the main mass flow.

13. Refrigeration system as defined in claim 1, wherein in the second operating mode liquid refrigerant of the main mass flow is subject to high pressure PH in the reservoir.

14. Refrigeration system as defined in claim 11, wherein the second operating mode corresponds to a subcritical operation.

15. Refrigeration system as defined in claim 1, wherein the control controls the refrigerant compressors in accordance with the refrigerating capacity required.

16. Refrigeration system as defined in claim 1, wherein the refrigerant compressors are adapted to be switched on or off individually with the control in accordance with the refrigerating capacity required.

17. Refrigeration system as defined in claim 1, wherein each refrigerant compressor with additional compressor stage is dimensioned such that the mass flow of refrigerant of the additional mass flow compressed by the additional compressor stage corresponds at the most to the mass flow of refrigerant of the main mass flow compressed by the main compressor stage in this refrigerant compressor.

18. Refrigeration system as defined in claim 1, wherein the refrigerant compressors with additional compressor stage are dimensioned such that the additional compressor stages of different refrigerant compressors compress different mass flows of refrigerant of the additional mass flow.

19. Refrigeration system as defined in claim 1, wherein the refrigerant compressors with additional compressor stage are reciprocating compressors.

20. Refrigeration system as defined in claim 19, wherein each of the refrigerant compressors with additional compressor stage has at least one cylinder for the additional compressor stage and at least one cylinder for the main compressor stage.

21. Refrigeration system as defined in claim 19, wherein the number of cylinders for the main compressor stage is greater than the number of cylinders for the additional compressor stage in each refrigerant compressor with additional compressor stage.

22. Refrigeration system comprising a refrigerant circuit, a main mass flow of a refrigerant being guided in said circuit, a refrigerant-cooling heat exchanger arranged in the refrigerant circuit on the high pressure side, an expansion cooling device arranged in the refrigerant circuit, said device cooling the main mass flow of the refrigerant in the active state and thereby generating an additional mass flow of gaseous refrigerant, a reservoir for liquefied refrigerant arranged in the refrigerant circuit, at least one expansion unit for liquefied refrigerant of the main mass flow, said expansion unit being arranged in the refrigerant circuit and having an expansion element and a post-connected heat exchanger on the low pressure side, said heat exchanger making refrigerating capacity available, and at least one refrigerant compressor arranged in the refrigerant circuit, said compressor having a main compressor stage and at least one additional compressor stage driven together with the main compressor stage, said two stages compressing refrigerant to high pressure PH, wherein the main compressor stage and the at least one additional compressor stage are adapted to be used such that either the main compressor stage compresses refrigerant from the main mass flow and the additional compressor stage compresses refrigerant from the additional mass flow or the main compressor stage and the additional compressor stage compress refrigerant from the main mass flow, in the case of at least two refrigerant compressors with additional compressor stage the additional compressor stages of different refrigerant compressors have a different volumetric displacement.

23. Refrigeration system as defined in claim 22, wherein for each refrigerant compressor with additional compressor stage the ratio of the volumetric displacement of the additional compressor stage to the volumetric displacement of the main compressor stage is different in relation to at least one of the other refrigerant compressors with additional compressor stage.

24. Refrigeration system as defined in claim 1, wherein in the first operating mode the reservoir for liquefied refrigerant operates at an intermediate pressure PZ and an additional expansion unit with an expansion element and a post-connected heat exchanger delivering refrigerating capacity is provided between the heat exchanger on the high pressure side and cooling the refrigerant and the reservoir for liquefied refrigerant.

25. Refrigeration system as defined in claim 19, wherein the refrigerant compressors have cylinder heads, outlet chambers and inlet chambers being designed in the case of the said cylinder heads so as to be essentially thermally decoupled.

26. Refrigeration system as defined in claim 1, wherein a check valve is provided for connecting an inlet chamber of the additional compressor stage to the low pressure connection of the main compressor stage.

27. Refrigeration system as defined in claim 26, wherein the check valve is provided in a valve plate of the respective refrigerant compressor.

28. Refrigeration system as defined in claim 27, wherein the connecting channel between the low pressure connection and the check valve runs in a cylinder housing.

* * * * *